US005918092A

United States Patent [19]

Hama

[11] Patent Number: 5,918,092

[45] Date of Patent: Jun. 29, 1999

[54] ROTARY DEVELOPMENT UNIT WHICH SUPPLIES FRESH TONER BACK TO A TONER SUPPLY CONTAINER

[75] Inventor: Junichi Hama, Ebina, Japan

[73] Assignee: Fuji Xerox Co., Ltd., Tokyo, Japan

[21] Appl. No.: 08/974,280

[22] Filed: Nov. 19, 1997

[30] Foreign Application Priority Data

Nov. 20, 1996 [JP] Japan ..... 8-309315

[51] Int. Cl.[6] ..... G03G 15/01

[52] U.S. Cl. ..... 399/227

[58] Field of Search ..... 399/223, 226, 399/227, 228

[56] References Cited

U.S. PATENT DOCUMENTS 5,585,598 12/1996 Kasahara et al. ..... 399/227
5,752,141 5/1998 Nishimura et al. ..... 399/227

FOREIGN PATENT DOCUMENTS

A-61-95370 5/1986 Japan .

*Primary Examiner*—S. Lee
*Attorney, Agent, or Firm*—Oliff & Berridge, PLC

[57] ABSTRACT

A rotary development unit includes a support frame having a plurality of developers arranged in a radial pattern and places any one of the developers in a development position opposite to a photosensitive drum by rotation while retaining the developers; a plurality of toner supply containers attached to the support frame so as to become adjacent to the respective developers; toner supply channels which are disposed substantially in parallel with a rotary shaft of the support frame and connect the respective developers to the adjacent toner supply containers; and supply augers which convey fresh toner to the developers from the toner supply containers within the toner supply channels according to a given number of rotations. In the rotary development unit, when the supply auger is suspended and the support frame is rotated, the fresh toner filled in the toner supply channel is conveyed to the toner supply container from the developer.

4 Claims, 7 Drawing Sheets

ROTARY DEVELOPMENT UNIT WHICH SUPPLIES FRESH TONER BACK TO A TONER SUPPLY CONTAINER

BACKGROUND OF THE INVENTION

1. Field of the Invention

The present invention relates to a development unit, for use in an electrophotographic copier or a printer, which includes a plurality of developers containing toner of different colors and visualizes an electrostatic latent image formed on an image carrier, such as a photosensitive drum, by means of a developer arbitrarily selected from the developers. More particularly, the present invention relates to an improvement in a so-called rotary development unit which exchanges a developer with another one in a position opposite to the image carrier while rotating the developer around a rotary shaft.

2. Description of the Related Art

An existing color image forming apparatus which employs an electrophotographic method includes a well-known color image forming apparatus which employs a so-called multiple transfer method. In this apparatus, yellow, cyan, magenta, and black toner images are sequentially transferred to a recording sheet, and these toner images are superimposed on each other to thereby form a full color image.

In the multiple transfer method, it is necessary to form a toner image of each color on an image carrier, such as a photosensitive drum, one after another. For this reason, a plurality of developers, each of which contains toner of each color, are disposed in a position where any one color developer is selectively placed opposite the image carrier. The other developers must be held in a receded position separated from the image carrier.

To this end, an existing color image forming apparatus employs a so-called rotary development unit (A-Color manufactured by Fuji Xerox Co., Ltd.) as means for selectively setting developers of four colors with in a development position. In this rotary development unit, a plurality of developers are positioned at equal intervals around a cylindrical rotary member (hereinafter referred to as a developer exchanger). As a result of revolution of the developer exchanger, an arbitrary developer is set in the development position, and the other developers are held in a receded position relative to the position where the developer is in close proximity to the image carrier.

If color toner, such as yellow toner, cyan toner, or magenta toner, is mixed with magnetic powder, the color developing characteristics of the color toner are deteriorated. For this reason, the color toner is usually non-magnetic toner, and each developer of the aforementioned color image forming apparatus develops an electrostatic latent image formed on the image carrier by means of a two-component development method; i.e., a two-component developing agent including a mixture of non-magnetic toner and magnetic carriers.

According to the development method that employs the two-component developing agent, only the toner of the mixture of toner and carriers contained in the developer is consumed through development of an electrostatic latent image. Therefore, each of the developers retained by the developer exchanger should be replenished with new toner (hereinafter referred to as fresh toner). In order to constantly maintain a desired development density of an electrostatic latent image, the quantity of fresh toner to be supplied to the developer must be strictly controlled.

The applicant of the present patent application has already put forward a rotary development unit which satisfies the foregoing demand. The rotary development unit is arranged so as to permit insertion or removal of a toner supply container storing fresh toner into or from the developer exchanger in such a way as to be in proximity to each color developer. The toner supply container attached to the developer exchanger is connected to the color developer through a toner supply channel disposed in parallel with the rotary shaft of the development exchanger. A conveyor screw comprising a rotary shaft around which a helical vane is wrapped (hereinafter referred to as an auger) is provided so as to pass through the toner supply channel. The fresh toner unloaded to the toner supply channel from the toner supply container is fed to the developer by rotation of the auger.

In the rotary development unit having the foregoing structure, the quantity of fresh toner corresponding to the number of rotations of the auger disposed in the toner supply channel is fed to the developer. Accordingly, if toner consumption is predicted from the image data read by the image forming apparatus, and the number of rotations of the auger is adjusted so as to correspond to the predicted toner consumption, the development density of an electrostatic latent image can be constantly maintained.

In the previously-described rotary development unit, the developers, the toner supply containers, and the toner supply channels revolve around the rotary shaft of the developer exchanger every time the developer exchanger is rotated for the purpose of exchanging the developer to be placed in the development position. Even in a state in which the augers housed in the toner supply channels are stopped, fresh toner moves along the helical vane of the auger and is naturally conveyed through the toner supply channel.

For this reason, in a case where the developer exchanger rotates in one direction, the fresh toner held in the toner supply channel is conveyed through the inside of the toner supply channel toward the developer or the toner supply container depending on the direction in which the helical vane of the auger is wrapped. In the former case, the developer is unintentionally replenished with fresh toner, thereby resulting in an excess quantity of toner being stored in the developer. In contrast, in the latter case, the fresh toner recedes to the toner supply container from the toner supply channel. Accordingly, if an attempt is made to replenish the developer with the fresh toner by effecting a given number of rotations of the auger, the quantity of fresh toner corresponding to the number of rotations of the auger cannot be supplied to the developer, thereby resulting in toner deficiency in the developer.

Such a problem is particularly likely to arise in a developer other than a black developer after a copy job has been repeatedly executed several times in a black and white mode. In order to prevent the surface of the latent image carrier from being soiled by toner, a home position at which any developer is spaced away from a latent image carrier is ensured in the color image forming apparatus that uses the rotary development unit. In a copy wait state, the developer exchanger is usually set in its home position. If there are successive copy jobs in a black and white mode, the black developer is carried from the home position to the development position where it faces the latent image carrier at the beginning of each job. Further, after the completion of the job, the black developer is returned to the home position. As a result, the developer exchanger is rotated for each job, and the other color developers are not used at all during the course of the copy jobs. If the copy jobs are repeated several times in a black and white mode, the fresh toner held in the toner supply channel of each of the other color developers; i.e., the yellow developer, the cyan developer, and the magenta developer, is unintentionally carried, thereby resulting in the foregoing problems being more noticeable.

In the case where an excess arises in the quantity of fresh toner to be supplied to the developer, there is no alternative way but to wait for consumption of the toner contained in the developer through development over time until the development density of an electrostatic latent image is adjusted. In contrast, in the case where there is a shortage of fresh toner in the developer, it is sufficient to rotate the auger housed in the toner supply channel to the number of rotations corresponding to the insufficient amount of the fresh toner.

SUMMARY OF THE INVENTION

The present invention has been contrived in view of the foregoing drawbacks in the art, and the object of the present invention is to provide a rotary development unit which exchanges a developer to be set opposite to an image carrier, as required, by rotation of a developer carrier retaining a plurality of developers in a circumferential position around the carrier; which prevents an excess quantity of fresh toner being supplied to the developer which would otherwise be caused by rotation of the developer exchanger; and which is capable of developing an electrostatic latent image formed on an image carrier in stable density.

Another object of the present invention is to prevent an insufficient amount of fresh toner being supplied to the developer which would otherwise be caused by rotation of the developer exchanger, and which is capable of developing an electrostatic latent image formed on an image carrier in a stable density.

To accomplish the foregoing problems, a rotary development unit including a plurality of developers for visualizing an electrostatic latent image formed on a latent image carrier with toner through development; a developer exchanger which rotates while retaining the developers in a circumferential position around the developer exchanger and places any one of the developers in a development position opposite to the latent image carrier; a plurality of toner supply containers which store fresh toner to be supplied to the respective developers and are attached to the developer exchanger adjacent to the respective developers; toner supply channels which are provided in substantially parallel with the rotary shaft of the developer exchanger and connect the developers to their adjacent toner supply containers; and toner conveyor device for conveying the quantity of fresh toner corresponding to a given number of rotations of the toner conveyor device, from the toner supply container to the developer through the toner supply channel, wherein the fresh toner in the toner supply channel is conveyed to the toner supply container from the developer when the toner conveyor device is suspended and the developer exchanger is rotated.

With the foregoing technological means, if the developer exchanger is rotated while the toner conveyor device for conveying fresh toner from the toner supply container to the developer is suspended, the fresh toner held in the toner supply channel is conveyed to the toner supply container from the developer. As a result, the fresh toner is unintentionally prevented from being supplied to the developer from the toner supply channel during rotation of the developer exchanger, thereby preventing an excess quantity of toner from being stored in the developer.

Further, with the foregoing technological means, the fresh toner is withdrawn to the toner supply container through the toner supply channel by rotation of the developer exchanger. As a result, the toner supply channel becomes empty, and hence even if the toner conveyor device is rotated after the developer exchanger has been rotated several times, the quantity of fresh toner corresponding to the number of rotations of the toner conveyor device cannot immediately be supplied to the developer. Conversely, fears are entertained as to a shortage of toner in the developer.

To eliminate these fears, when the rotary developing unit of the present invention is practiced, it is desirable to add to following features to the developing unit; namely, number-of-rotation count section for counting the number of rotations achieved by the developer exchanger until the developer receded from the development position is reset to the same position; and quantity-of-supply correction section which determines, from the number of counts counted by the number-of-rotation count section, a corrected value of a time period over which the toner conveyor device is rotatively driven (hereinafter simply referred to as toner-conveyor drive time); and which increases the time period only by the corrected value.

If the rotary development unit, according to the present invention, is provided with the foregoing features, the number-of-rotation count section counts the number of rotations achieved by the developer exchanger. As a result, from the count value, it is possible to ascertain the extent to which the fresh toner has receded toward the toner supply container through the toner supply channel. If the toner-conveyor drive time is corrected and increased by means of the quantity-of-supply correction section on the basis of the count value, a shortage of fresh toner in the developer can be eliminated.

Even when the developer exchanger is in rotation, the fresh toner is conveyed to the developer through the toner supply channel at the time of rotation of the toner conveyor device, and the toner supply channel is filled with the fresh toner. Accordingly, if the toner conveyor device is subsequently rotated, the quantity of fresh toner corresponding to the number of rotations of the toner conveyor device is immediately supplied to the developer. For this reason, it is sufficient to count the number of rotations of the developer exchanger with the number-of-rotation count section only when the toner conveyor device is suspended.

Even if the developer exchanger makes tens of revolutions, the maximum distance over which the fresh toner is conveyed toward the toner supply container through revolution is equal to the length of the toner supply channel. There is no need to correct the toner-conveyor drive time in excess of the length of the toner supply channel. Accordingly, an upper limit value corresponding to the length of the toner supply channel should preferably be set as a corrected value for the toner-conveyor drive time.

DETAILED DESCRIPTION OF THE PREFERRED EMBODIMENTS

By reference to the accompanying drawings, a rotary development unit according to the present invention will be described in detail.

Figure 1:
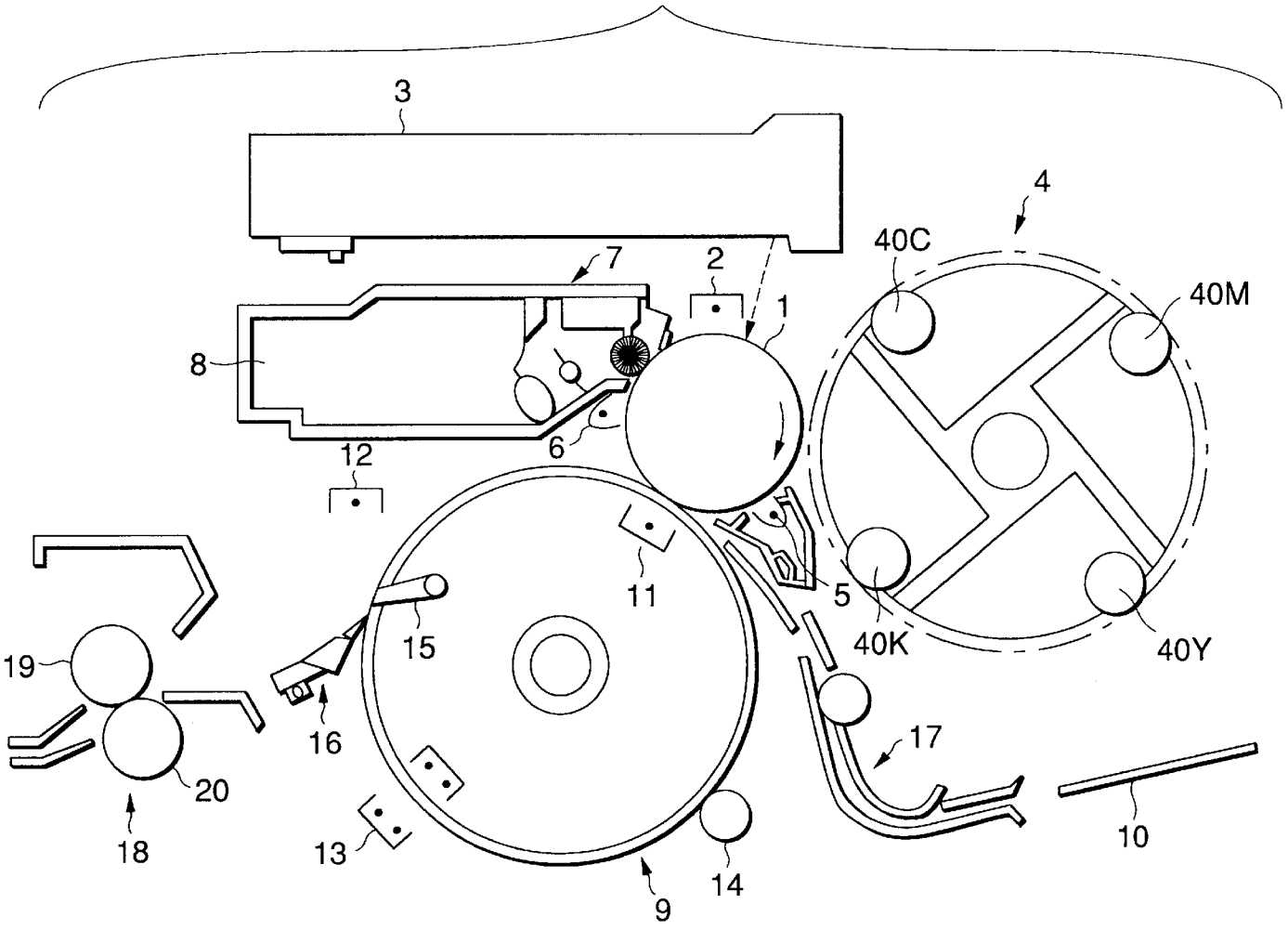
FIG. 1 a schematic view showing the configuration of one example of a color copier to which a rotary development unit according to the present invention is applied.

FIG. 1 shows one example of a color copier equipped with the rotary development unit according to the present invention.

In the drawings, reference numeral 1 designates a photosensitive drum (an image carrier); 2 designates an electrostatic charging corotron for previously charging the surface of the photosensitive drum 1; 3 designates a laser beam scanner used for writing an electrostatic latent image on the photosensitive drum 1 charged by the electrostatic charging corotron 2; 4 designates a rotary development unit which rotatably retains four developers 40K, 40Y, 40M, and 40C for respectively receiving a black (K) toner image, a yellow (Y) toner image, a magenta (M) toner image, and a cyan (C) toner image and selects a developer in a switchable manner, as required; 5 designates a prior-to-transfer charge-removal corotron; 6 designates a prior-to-cleaning corotron; 7 designates a cleaner for removing residual toner from the photosensitive drum 1; and 8 designates a recovery tank which is integrally formed with the cleaner 7 and collects wasted toner.

Reference numeral 9 designates a transfer drum around which a recording sheet 10 is wrapped, and a toner image of each color is transferred to the recording sheet 10 from the photosensitive drum 1, whereby one color toner image is superimposed on another color toner image on the recording sheet 10. A dielectric film made of, such as polyvinylidene fluoride, is stretched across a drum frame. The recording sheet 10 is electrostatically attached to the dielectric film.

The transfer drum 9 is provided with a transfer corotron 11 for transferring a toner image from the photosensitive drum 1 to the recording sheet 10; a charge removal corotron 12 for removing electric charges from the recording sheet 10 after completion of transfer of the final color toner image onto the recording sheet 10; a charge removal corotron 13 for removing electric charges from the dielectric film after the removal of the recording sheet 10; a cleaning brush 14 for wiping off paper dust, or the like, adhered to the dielectric film; an inner press roller 15 for pressing the dielectric film from the inside of the transfer drum 9 when the recording sheet 10 is removed; and a release claw 16 for exfoliating the recording sheet 10 from the transfer drum 9.

Reference numeral 17 designates a sheet supply system for guiding the recording sheet 10 supplied from a sheet supply cassette (not shown) to the transfer drum 9. The recording sheet 10 is directly fed to a nip position where the photosensitive drum 1 comes into contact with the transfer drum 9. More specifically, the transfer corotron 11 also plays a roll in attaching the recording sheet 10 to the transfer drum 9. When the toner image on the photosensitive drum 1 is transferred to the recording sheet 10, the recording sheet 10 is simultaneously attached to the transfer drum 9.

Reference numeral 18 designates a fixing unit which fixes an unfixed toner image on the recording sheet 10 by enabling insertion of the recording sheet 10 which has finished undergoing the image transfer process. The fixing unit 18 is made up of a heating roll 19 having a built-in heater and a press roller 20 pressed against the heat roll 19.

In the color copier according to the present embodiment having the foregoing structure, the photosensitive drum 1 is exposed to light through use of the laser beam scanner 3 on the basis of the image data concerning an original read by an original reading section (not shown), whereby a black (K) electrostatic latent image is written on the photosensitive drum 1. In contrast, the black developer 40K of the rotary development unit 4 is set in a position opposite to the photosensitive drum 1. The electrostatic latent image is developed by means of the black developer 40K after a slight delay with reference to the timing at which the image is written. The thus-formed black (K) toner image is transferred, at predetermined timing, to the recording sheet 10 supplied from the sheet supply system 17. In association with the transfer of the toner image to the recording sheet 10, the recording sheet 10 is attached to the transfer drum 9. After that, the transfer drum 9 revolves while retaining the recording sheet 10. After the black developer 40K has finished developing the toner image, the developer is exchanged with another developer before the transfer drum 9 finishes making one rotation. Specifically, the yellow developer 40Y is set to the position opposite to the photosensitive drum 1 by effecting 90ûiturn o development unit.

From then on, the foregoing operations are repeated every one turn of the transfer drum 9. Every time the transfer drum 9 rotates, the yellow (Y) toner image, the magenta (M) toner image, or the cyan (C) toner image is transferred from the photosensitive drum 1 to the recording sheet 10 retained by the transfer drum 9. As a result, toner images having four colors are superimposed one on another on the recording sheet 10. After the transfer of the cyan (C) toner image to the recording sheet 10 has been completed, the recording sheet 10 is exfoliated from the transfer drum 9. The thus-exfoliated recording sheet 10 is discharged to a discharge tray (not shown) by way of a fixing unit 18.

The structure of the rotary development unit 4 will be described in detail.

Figure 2:
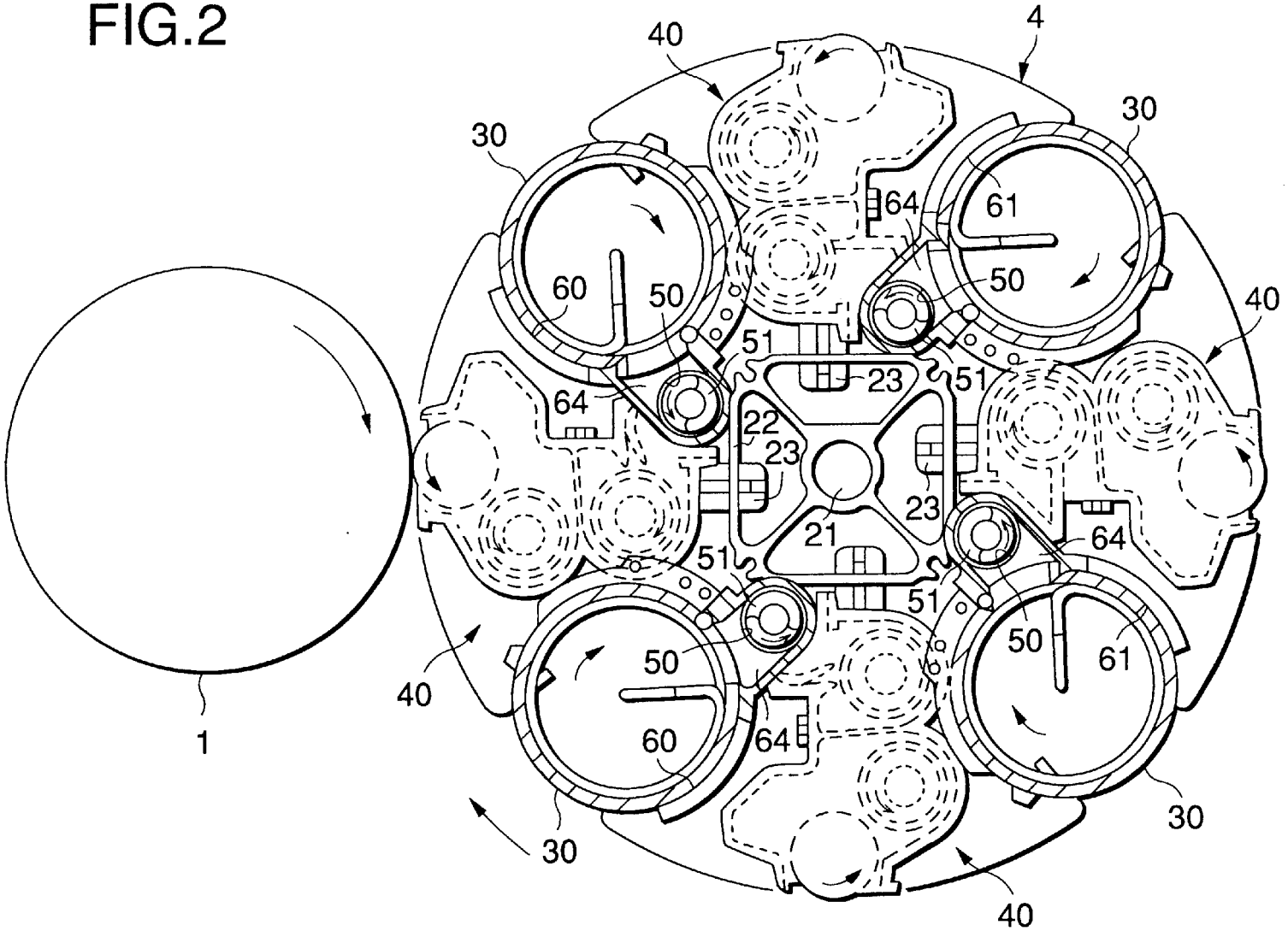
FIG. 2 is a cross-sectional front view showing one embodiment of the rotary development unit according to the present invention.

As is evident from the cross-sectional view shown in FIG. 2, the rotary development unit 4 includes a rotary shaft 21 provided at the center of the rotary development unit and a support frame 22 fixed on the rotary shaft 21. The aforementioned four color developers 40 are fixed to the support frame 22 in a radial pattern through use of mount pins 23. A developer exchanger motor (not shown) is connected to the rotary shaft 21 via a clutch. The support frame 22 is rotated by driving the developer exchanger motor, thereby enabling a desired developer 40 to be set in the development position opposite to the photosensitive drum 1. Accordingly, the rotary shaft 21 and the support frame 22 correspond to the developer exchanger according to the present invention.

In the rotary development unit 4, toner supply containers 30 are provided so as to be adjacent to the respective developers 40. The fresh toner stored in each of the toner supply containers 30 is supplied to each of the developers 40 via a toner supply channel 50 disposed in parallel with the rotary shaft 21, as required. The toner supply container 30 is cylindrically formed and can be removably inserted into a container inlet port 61 formed in a panel member 60, which will be described later, from the front side of the rotary development unit 4 (i.e., in the fore direction at right angles to a drawing sheet of FIG. 2).

Figure 3:
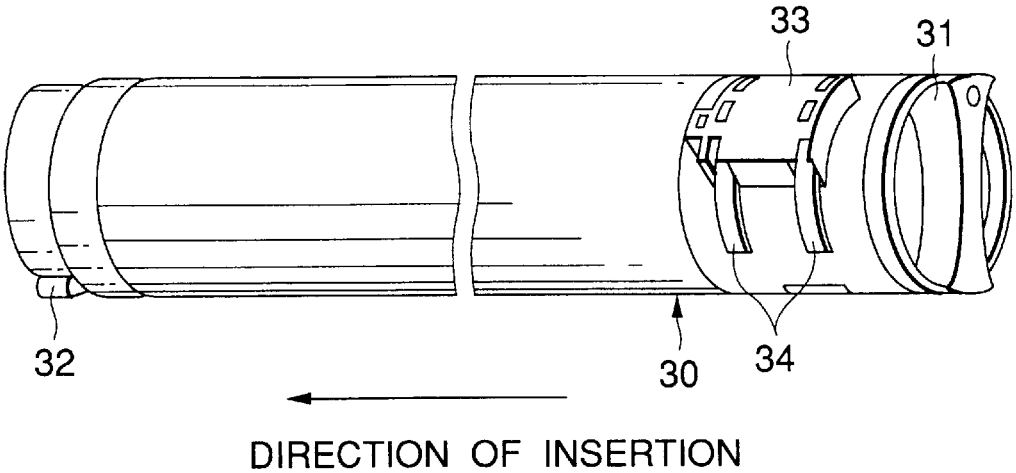
FIG. 3 is a perspective view showing a toner supply container according to the embodiment.

FIG. 3 shows a toner supply container 30. A knob 31 protrudes from the proximate end face of the toner supply container 30 in the direction designated by arrow in which the toner supply container 30 is inserted. A protuberance 32 for indexing purposes is formed on the circumference of the distal end of the toner supply container 30 in the back direction designated by arrow. The protuberance 32 is utilized when the toner supply container 30 is inserted into the rotary development unit 4. A toner outlet port used for discharging fresh toner from the toner supply container 30 is formed in the circumferential surface of the toner supply container 30 in the vicinity of the proximate end face in the direction in which the toner supply container is inserted. As shown in the drawing, in a state in which the toner supply container 30 is not attached to the rotary development unit 4, the toner outlet port is closed by means of a shutter 33 provided on the container. The shutter 33 is engaged with a pair of L-shaped rails 34, 34 formed on the circumferential surface of the toner supply container 30. The toner outlet port is opened by sliding the shutter 33 along the rails 34. Further, a protruding wall (not shown) is formed around the toner outlet port, and the shutter 33 abuts against the protruding wall after having closed the toner outlet port.

Figure 4:
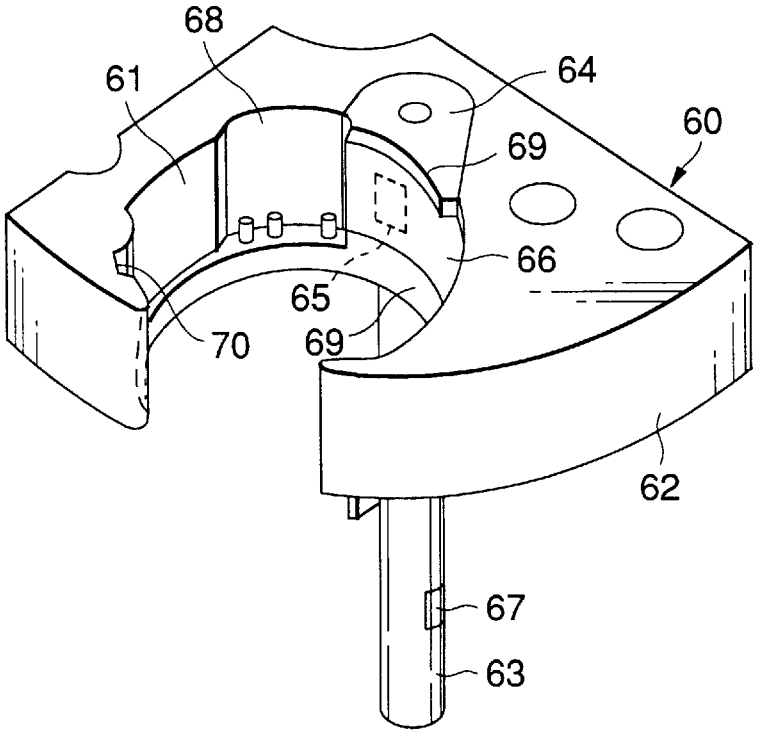
FIG. 4 is a perspective view showing a panel member according to the present embodiment.
Figure 5:
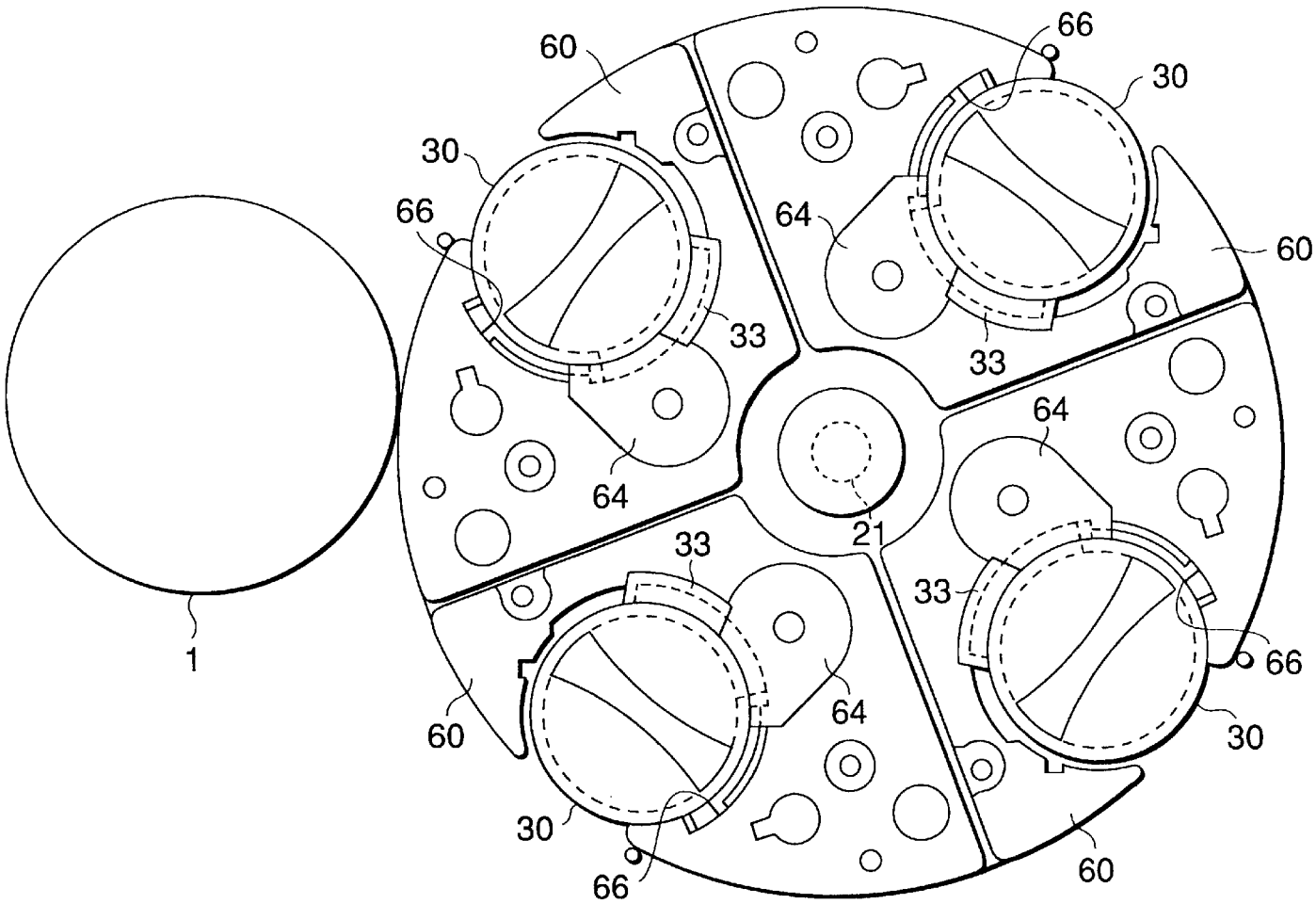
FIG. 5 is a front view showing the rotary development unit according to the present embodiment.

FIG. 4 shows a panel member 60 having the container inlet port 61 for receiving the toner supply container 30 and the toner supply channel 50. The panel member 60 has a fan-shaped form and includes a container retaining section 62 in which the container inlet port 61 is formed and a pipe 63 which protrudes from the reverse side of the container retaining section 62 and has the toner supply channel 50 formed therein. As shown in FIG. 5, four panel members 60 corresponding to the respective developers are attached to the support frame 22, thereby completing the front panel of the rotary development unit 4.

The container retaining section 62 has a toner receiver chamber 64 for receiving the fresh toner discharged from the toner supply container 30. The toner receiver chamber 64 is opened toward the container inlet port 61 via a toner inlet port 65. As shown in FIG. 3, in the state in which the toner supply container 30 is not attached to the container inlet port 61, the toner inlet port 65 is closed by means of a shutter 66 provided on the receiver chamber 64. The toner supply channel 50 formed in the pipe 63 is connected to the toner receiver chamber 64. The fresh toner stored in the toner supply container 30 is conveyed to the toner supply channel 50 via the toner receiver chamber 64. A toner outlet port 67 is formed in the vicinity of the front end of the pipe 63 protruding from the container retaining section 62. The fresh toner conveyed from the toner receiver chamber 64 via the toner supply channel 50 is unloaded to the developer 40 via the toner outlet port 67.

An indentation 68 is formed in the circumferential surface of the container inlet port 61 into which the toner supply container 30 is fitted. When the toner supply container 30 is fitted into the container inlet port 61, the shutter 33 protruding from the circumferential surface of the toner supply container 30 is received by the indentation 68. A pair of L-shaped rails 69 are formed on the side wall of the toner receiver chamber 64 adjoining the indentation 68. The aforementioned shutter 66 engages the rails 69 in a slidable manner. Reference numeral 70 in FIG. 4 designates an indentation for receiving the protuberance 32 of the toner supply container 30.

The toner supply container 30 is fitted into the container inlet port 61 of the panel member 60 in such a way that the shutter 33 is received by the indentation 68 of the container inlet port 61. In this state, if the knob 31 of the toner supply container 30 is turned in a rightward direction, the toner supply container 30 itself rotates around its axis while the shutter 33 is received by the indentation 68. The shutter 33 slides relatively to the toner supply container 30, whereby a toner exit of the toner container 30 is opened. The thus-opened toner exit is moved until it is opposite to the toner inlet port 65 opened in the toner receiver chamber 64. Concurrently, the protruding wall formed around the outlet port presses the shutter 66 provided on the receiver chamber 64, so that the shutter 66 slides together with the toner supply container 30, to thereby open the toner inlet port 65. As a result, the toner exit port 33 of the toner supply container 30 is opposite to the toner inlet port 65 of the toner receiver chamber 64 while they are open (see FIG. 5), thereby allowing the fresh toner stored in the toner supply container 30 to flow into the toner receiver chamber 64.

Figure 6:
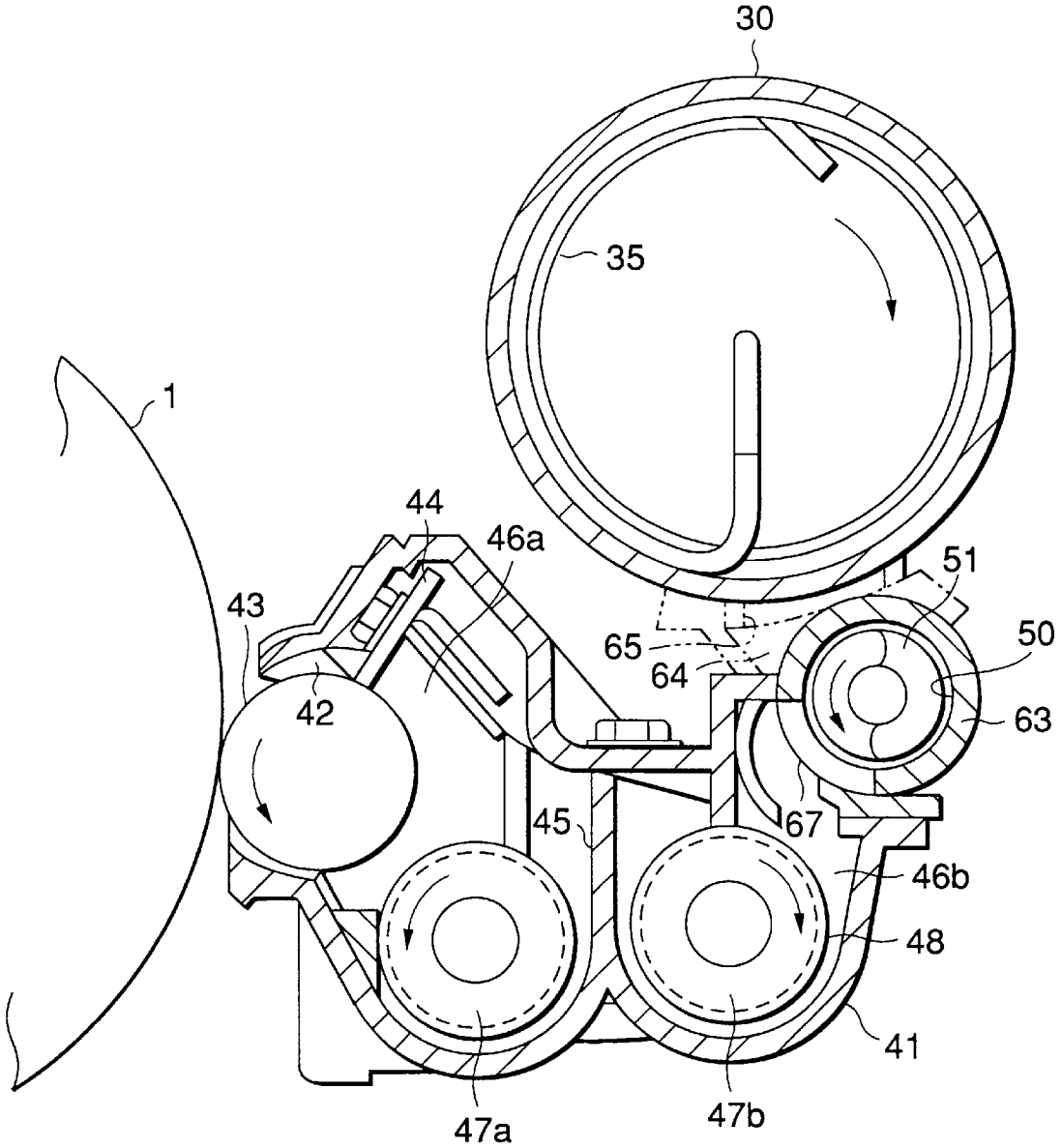
FIG. 6 is a cross-sectional view showing only a developer carried to a development position from the rotary development unit according to the present embodiment.

FIG. 6 is a cross-sectional front view showing the developer 40 set in the development position. In the drawings, a helical coil agitator 35 is housed in the toner supply container 30, and the fresh toner stored in the toner supply container 30 is conveyed to the toner exit port 33 by rotation of the coil agitator 35. The thus-conveyed fresh toner is unloaded into the toner receiver chamber 64 through the toner exit port. A supply auger 51 is housed so as to pass through the toner receiver chamber 64 and the toner supply channel 50. By rotation of the supply auger 51, the fresh toner is conveyed to the toner outlet port 67 from the toner receiver chamber 64 through the inside of the toner supply channel 50 and is finally fed into the developer 40. In the present embodiment, the supply auger 51 corresponds to the toner conveyor means according to the present invention.

The developing agent used for each developer 40 is a two-component developing agent comprising a mixture of non-magnetic toner and magnetic carriers. In each of the developers 40, the developing agent is agitated in a mixing manner. An electrostatic latent image written on the photosensitive drum 1 is developed by means of a so-called magnetic brush developing method.

As shown in FIG. 6, reference numeral 41 designates a housing incorporating the developing agent, and a developing-agent outlet port 42 is formed in the housing 41 so as to be opposite to the photosensitive drum 1. A development roller 43 is disposed in the developing-agent outlet port 42 for producing a magnetic brush of the developing agent. The development roller 43 is formed from a cylindrical sleeve which covers a magnet roll polarized with a plurality of magnetic poles and rotates in the direction designated by arrow. The magnetic carriers are attached to the circumferential surface of the sleeve in the form of a chain by dint of the magnetic force of the magnet roll, to thereby form a magnetic brush of the developing agent. In association with the rotation of the sleeve, the magnetic brush is carried to the outside of the housing 41 from the developing-agent outlet port 42, so that the tip of the magnetic brush comes into slidable contact with the photosensitive drum 1. A trimmer blade 44 is fixed to the housing 41 while a given clearance is ensured between the development roller 43 and the trimmer blade 44. The tip of the magnetic brush formed over the circumferential surface of the development roller 43 is trimmed to a certain length by means of the trimmer blade 44.

A partition 45 is provided in the housing 42 in parallel with the axis of the development roller 43. The inside of the housing 41 is divided into two developing agent chambers 46*a*, 46*b* by means of the partition 45. A screw auger 47*a* is provided in the first developing agent chamber 46*a* so as to be adjacent to the development roll 43. The screw auger 47*a* rotates in the direction designated by arrow and conveys the developing agent stored in the first developing agent chamber 46*a* toward the front side of the developer 40 (i.e., the proximal end of the developer 40 in the direction at right angles to the drawing sheet of FIG. 6). In contrast, a screw auger 47*b* is provided in the second developing chamber 46*b* adjacent to the first developing chamber 46*a* with the partition 45 between them. The screw auger 47*b* rotates in the direction designated by arrow and conveys the developing agent stored in the second developing agent chamber 46*b* toward the rear side of the developer 40 (i.e., the distal end of the developer 40 in the direction at right angles to the drawing sheet of FIG. 6).

An opening for connecting the first developing agent chamber 46*a* to the second developing agent chamber 46*b* is formed on each longitudinal end of the partition 45. The developing agent conveyed toward the front side in the first developing agent chamber 46*a* through rotation of the screw auger 47*a* is fed to the second developing agent chamber 46*b* by way of the opening formed in the vicinity of the front side of the developer 40. In contrast, the developing agent conveyed toward the rear side in the second developing agent chamber 46*b* through rotation of the screw auger 47*b* is fed to the first developing agent chamber 46*a* by way of the opening formed in the vicinity of the rear side of the developer 40. More specifically, in the developer 40, the developing agents are circulated around the partition 45 in a certain direction through rotation of the pair of screw augers 47*a,* 47*b*. The developing agents are agitated through such circulation, and the frictional electrification of the toner is promoted.

The toner supply channel 50 is situated at an elevated position with reference to the second developing agent chamber 46*b* and is connected to the second developing agent chamber 46*b* through the toner outlet port 67. The fresh toner conveyed from the toner supply container 30 through the toner supply channel 50 is unloaded into the front side of the second developing chamber 46*b*. Accordingly, the fresh toner supplied to the developer 40 cannot flow into the first developing agent chamber 46*a* without passing through the second developing agent chamber 46*b* from the front side toward the rear side of the developer 40. The toner is agitated and mixed with the carriers during the course of transfer of the toner, thereby electrifying the toner. As a result, all the toner attached to the development roll 43 in the first developing agent chamber 46*a* is provided with a sufficient amount of electric charge. Reference numeral 48 designates a movable closure which is supported at one end by the housing 41 through use of a shaft. In a case where the developer 40 is turned upside down as a result of rotation of the rotary development unit 4, the closure 48 covers the toner outlet port 67 to thereby prevent reverse flow of the developing agent to the toner supply channel 50 from the second developing agent chamber 46*b*.

In the developer 40, according to the present embodiment, having the foregoing structure, as previously mentioned, the developing agent stored in the first developing agent chamber 46*a* is adsorbed by the development roll 43, so that a magnetic brush is formed from the developing agent over the circumferential surface of the development roll 43. The magnetic brush comes into slidable contact with the circumferential surface of the photosensitive drum 1 as the development roll 43 rotates. At this time, the toner is merely attached to the carriers forming the magnetic brush in an electrostatic manner and, therefore, is attracted toward the photosensitive drum 1 in accordance with the electric potential of an electrostatic latent image formed on the photosensitive drum 1. The toner is liberated from the carriers and adheres to the photosensitive drum 1. As a result, the electrostatic latent image is developed with toner. Further, since the carriers are retained by the development roll 43 by dint of the magnetic force, they do not adhere to the photosensitive drum 1. The carriers are recovered into the housing 41 and are removed from the development roll 43. The thus-removed carries are then returned to the first developing agent chamber 46*a*.

Figure 7:
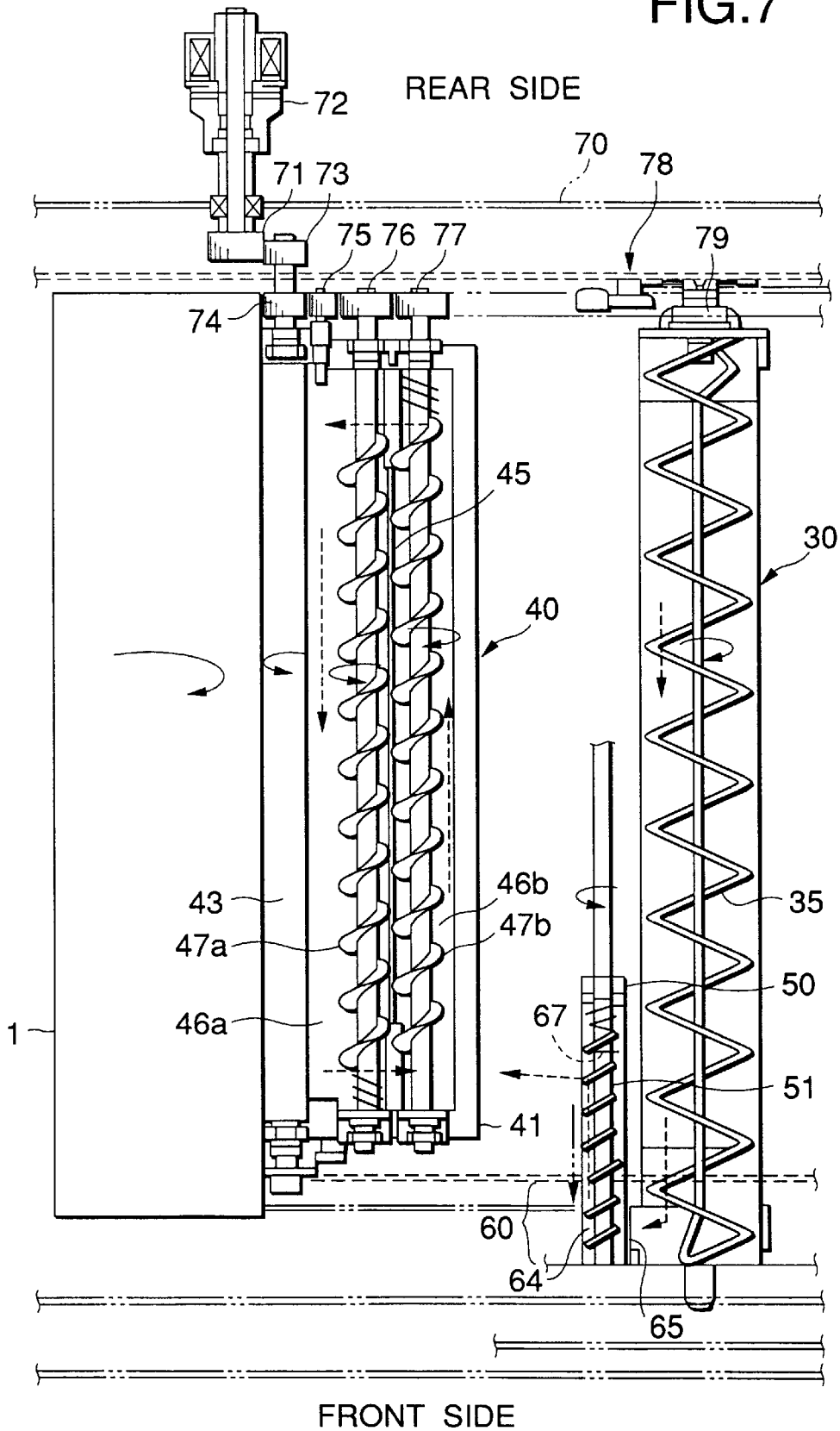
FIG. 7 is an exploded view showing the positional relationship between a developer, a toner supply container, and a toner supply channel according to the present embodiment.

FIG. 7 shows a drive system of the developer 40.

A rear frame 70 of the copier according to the embodiment is provided with drive gears 71 so as to correspond to the respective development positions of the developers 40. These drive gears 71 are connected to a drive motor (not shown) via transmission clutches 72. In contrast, the rotary shaft of the development roll 43 protrudes from the rear side of each developer 40, and an input gear 73 is fixed to the tip end of the rotary shaft so as to mesh with the drive gear 71. Accordingly, if the rotary development unit 4 rotates and brings the developer 40 in the development position opposite to the photosensitive drum 1, the input gear 73 of the developer 40 meshes with the drive gear 71 of the rear frame 70, thereby transmitting the torque of the drive motor to the development roll 43. Further, the rotation of the development roll 43 is transmitted to each of the screw augers 47*a,* 47*b* of the developer 40 via gears 74 through 77. If the development roll 43 commences rotating while the developer 40 is held in the development position, the screw augers 47*a,* 47*b* commence agitating the developing agent in conjunction with the rotation of the development roll 43.

A gear 78 for driving the coil agitator 35 of the toner supply container 30 is provided on the rear side of the rotary development unit 4. When the toner supply container 30 is fitted into the container inlet port 61 of the panel member 60, the coil agitator 35 is connected to the gear 78 via a coupling 79. Rotation is transmitted to the gear 78 from the development roll 43 via a plurality of gears (not shown), so that the development roll 43 and the coil agitator 35 are rotated in association with each other. During the course of rotation of the development roll 43 while the developer 40 is held in the development position, the coil agitator 35 sends the fresh toner stored in the toner supply container 30 to the toner exit port at all times. Accordingly, the toner receiver chamber 64 of the panel member 60 is always filled with fresh toner.

The supply auger 51 housed in the toner supply channel 50 is driven by means of a toner supply motor (not shown) differing from that is used for driving the development roll 43 and the coil agitator 35. The toner supply motor is also disposed in such a way as to correspond to the development position and is configured so as to be connected to the supply auger 51 only when the developer 40 is held in the development position. In short, the fresh toner is supplied to the developer 40 only when the developer 40 is set in the development position. As previously mentioned, when the developer 40 is set in the development position, the toner receiver chamber 64 is always filled with fresh toner by means of operation of the coil agitator 35. For this reason, the fresh toner is incessantly fed to the inside of the toner supply channel 50 as a result of rotation of the supply auger 51. The quantity of fresh toner unloaded to the developer 40 from the toner supply channel 50 only depends on the number of rotations of the supply auger 51. Therefore, in the copier according to the present embodiment, a drive signal used for driving the toner supply motor is generated in the manner as previously described, and the quantity of fresh toner to be supplied to the developer 40 is strictly controlled.

When the rotary development unit 4 is rotated in order to exchange the developer 40 with another one to be placed in the development position, the developer 40 and the toner supply container 30 revolve around the rotary shaft 21. Even when the toner supply motor is suspended, the fresh toner filled in the toner supply channel 50 is conveyed through the toner supply channel 50 as if the toner supply channel 50 was rotating. As a result, depending on the direction in which the helical vane is wrapped around the shaft of the supply auger 51, the fresh toner stored in the toner supply channel 50 is unintentionally supplied to the developer 40 during the course of rotation of the rotary development unit 4. The development density of an electrostatic latent image cannot be controlled to a desired density.

To prevent such a problem, as shown in FIG. 2, the developer 40 is exchanged by rotation of the support frame 22 in a clockwise direction, whilst fresh toner is supplied to the developer 40 by rotation of the supply auger 51 in a counterclockwise direction. With such a configuration, if the developer 40 is exchanged by rotation of the rotary development unit 4 while the supply auger 51 is suspended, the supply auger 51 is eventually rotated clockwise within the toner supply channel 50 during the course of exchange of the developer 40. The fresh toner filled in the toner supply channel 50 is conveyed toward the toner receiver chamber 64 from the toner outlet port 67, thereby preventing unintentional feeding of fresh toner to the developer 40.

Figure 8:
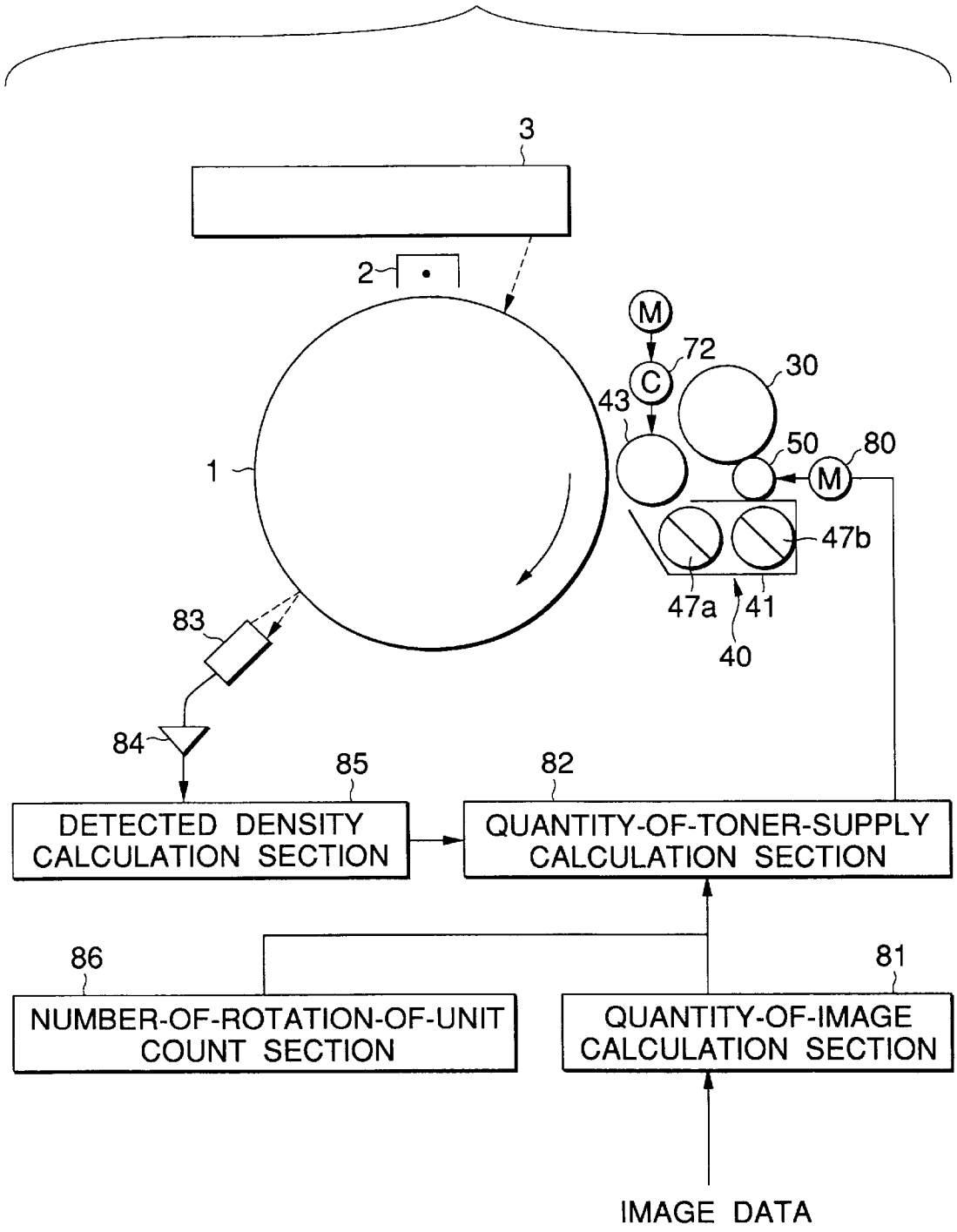
FIG. 8 is a block diagram showing a control system of a toner supply motor according to the present embodiment.

FIG. 8 is a block diagram showing a control system of the toner supply motor.

To control a mixture ratio of toner to carrier within the developer 40, there is a need for ascertaining the quantity of toner consumed by the developer 40, as well as for supplying the quantity of fresh toner corresponding to the quantity of consumed toner to the developer 40 from the toner supply channel 50. To this end, in the copier according to the present embodiment, the quantity of toner required to develop an electrostatic latent image which is formed on the photosensitive drum 1 on the basis of the image data received from the original reader (not shown) is calculated from the image data for each developer 40. On the basis of the result of such calculation, the quantity of fresh toner supplied to the developer 40 is determined.

More specifically, the image data converted into 8 bits of digital signal by means of an analog-to-digital converter (A/D converter) (not shown) are input to a quantity-of-image calculation section 81. The quantity-of-image calculation section 81 calculates an output level of each of the pixels forming the image data and converts the thus-calculated output level to the number of video counts which serves as an indicator of toner consumption. The number of video counts is input to a quantity-of-toner-supply calculation section 82 consisting of a microcomputer, and the quantity-of-toner-supply calculation section 82 calculates, from the number of video counts, the time period during which a toner supply motor 80 is driven. When the developer 40 to be supplied is placed in the development position, the quantity-of-toner-supply 82 generates a drive signal for the toner supply motor 80. The thus-generated drive signal is output to the toner supply motor 80. As a result, the supply auger 51 is rotated, and only a given quantity of fresh toner is supplied to the developer 40 from the toner supply channel 50.

Since there may arise a maximum of 200 msec lag until the toner supply motor 80 responds to the drive signal, the toner supply motor 80 is intermittently driven every 500 msec. The quantity-of-toner-supply calculation section 82 adds up the calculated time required to drive the toner supply motor 80 (hereinafter simply referred to as drive time) and generates a drive signal for the toner supply motor 80 every time the sum of the drive time exceeds 500 msec. After the generation of the drive signal, 500 msec is subtracted from the sum. As a result, the toner supply motor 80 is intermittently driven every time the sum of drive time output from the quantity-of-toner-supply calculation section 82 exceeds 500 msec, thereby ensuring feeding of fresh toner to the developer 40.

Simple prediction of toner consumption of each developer 40 from the image data may result in a risk of failure to accurately feed the quantity of fresh toner corresponding to the toner consumption to the developer if actual toner consumption is different from the predicted toner consumption. For this reason, in the copier according to the present embodiment, a toner image of test pattern (hereinafter referred to as a reference patch) is formed on the photosensitive drum 1 once every several copies. The development density of the reference patch is detected, and the quantity of fresh toner to be supplied to each developer 40 is determined on the basis of the result of such detection.

More specifically, an electrostatic latent image having an image density of 50% is written on the photosensitive drum 1 through use of the laser beam scanner 3. The thus-formed latent image is developed by the developer 40, and the reference patch is formed. A photosensor 83 is disposed in the vicinity of the photosensitive drum1 and reads the light reflected from the reference patch to thereby produce a detection signal corresponding to the intensity of the reflected light. The detection signal is input to a detected density calculation section 85 after having been amplified by means of an amplifier 84, and the detected density calculation section 85 calculates the development density of the reference patch from the detection signal and outputs to the quantity-of-toner-supply calculation section 82 a density signal corresponding to the result of calculation. The quantity-of-toner-supply 82 compares the received density signal with the pre-stored density signal having an image density of 50%, to thereby determine whether or not the difference in density between the two signals is greater than a tolerance. If the difference is determined to be greater than the tolerance, the time period during which the toner supply motor 80 is suspended (hereinafter simply referred to as suspension time) is calculated from the difference in density. The suspension time is subtracted from the drive time of the toner supply motor 80 that is summed on the basis of the image data. In contrast, if the difference in density is determined to be smaller than the tolerance, additional time during which the toner supply motor 80 is driven (hereinafter simply referred to as additional drive time) is calculated from the difference in density. The thus-calculated additional drive time is added to the sum of the drive time of the toner supply motor 80. As a result, toner deficiency in the developer 40 is ascertained on the basis of the actual development density of an electrostatic latent image, and the quantity of fresh toner to be supplied to the developer 40 can be increased or decreased corresponding to the quantity of toner deficiency. Consequently, the development density of the electrostatic latent image can be constantly maintained by controlling the quantity of fresh toner to be supplied to the developer 40.

In order to prevent the fresh toner filled in the toner supply channel 50 from spilling in the developer 40 as a result of rotation of the rotary development unit 4, as previously mentioned, the direction in which the supply auger 51 is rotated is set so as to be opposite to the direction in which the rotary development unit 4 is rotated. When the rotary development unit 4 is rotated, the fresh toner is conveyed to the toner receiver chamber 64 through the inside of the toner supply channel 50. However, if the fresh toner is reversely conveyed to the toner receiver chamber 64, the fresh toner disappears from the vicinity of the toner outlet port 67 in the toner supply channel 50. As a result, even if the toner supply motor 80 is rotated, no fresh toner is supplied to the developer 40 until the reversely-conveyed fresh toner arrives at the toner outlet port 67, thereby making it impossible to supply to the developer 40 the quantity of fresh toner corresponding to the drive time of the toner supply motor 80.

The shortage of the quantity of toner supply stemming from the conveyance of fresh toner through the toner supply channel 50 in the reverse direction corresponds to the number of rotations of the rotary development unit 4. Therefore, in the present embodiment, there is counted the number of rotations achieved by the rotary development unit 4 until the developer 40 once returned from the development position is again placed in the development position. An increment for the drive time of the toner supply motor 80 is determined on the basis of the count value.

More specifically, the copier is provided with an illustrated number-of-rotation-of-unit count section 86 which counts the number of rotations achieved by the rotary development unit 4 after the developer 40 has been left from the development position until that development unit 4 is placed in the development position again. A count signal representing the count value is input to the quantity-of-toner-supply calculation section 82, where an increment for the drive time of the toner supply motor 80 is calculated from the count signal. The thus-calculated increment is added to the sum of the drive time of the toner supply motor 80 calculated on the basis of the image data. In other words, the quantity-of-supply correction means according to the present invention is implemented by means of the quantity-of-toner-supply calculation section.

As a result, the drive time of the toner supply motor 80 can be increased by only the period of time corresponding to the time required for the fresh toner returned through the toner supply channel 50 to arrive at the toner outlet port 67 again. As a result, it becomes possible to prevent a shortage of fresh toner to be supplied to the developer 40 which would otherwise be caused by rotation of the rotary development unit 4.

In consideration of the fact that the fresh toner is constantly unloaded from the toner supply container 30 into the toner receiver chamber 64 connected to the toner supply channel 50, even if the rotary development unit 4 is rotated, the maximum distance over which the fresh toner is conveyed through the toner supply channel 50 in the reverse direction corresponds to merely the length of the toner supply channel 50. Accordingly, if the number of rotations achieved by the rotary development unit 4 counted by the number-of-rotation-of-unit count section 86 are unlimitedly converted into an increment for the drive time of the toner supply motor 80, a fear will be entertained as to an excess quantity of toner supplied to the developer 40.

In the present embodiment, in order to eliminate such a fear, an upper limit value corresponding to the length of the toner supply channel 50 is set with respect to an increment for the drive time of the toner supply motor 80 calculated from the number of rotations of the rotary development unit 4. If the an increment for the drive time of the toner supply motor 80 exceeds a preset upper limit value, the upper limit value is added to the drive time of the toner supply motor 80 calculated on the basis of the image data, thereby enabling accurate control of the quantity of fresh toner to be supplied to the developer 40.

In the rotary development unit 4 according to the present embodiment, the supply auger 51 is connected to the toner supply motor 80 only at the development position. Consequently, the fresh toner filled in the toner supply channel 50 is prevented from being supplied to the developer 40 during the course of rotation of the rotary development unit 4. The fresh toner is conveyed solely to the toner receiver chamber 64 through the toner supply channel 50. Accordingly, the rotation of the rotary development unit 4 results in solely the conveyance of fresh toner in the reverse direction. For this reason, the number of all rotations achieved by the rotary development unit 4 is counted by the unit number-of-rotation count section 86.

If the copier is also configured so as to supply fresh toner to the developer 40 during the course of rotation of the rotary development unit 4, there is a need to count the number of rotations of the rotary development unit 4 when the fresh toner is not supplied to the developer 40; i.e., the number of rotations achieved by the rotary development unit 4 only when the fresh toner is conveyed to the toner receiver chamber 64 through the toner supply channel 50, by means of the unit number-of-rotation count section.

[Advantageous Results of the Invention]

As has been described above, in the rotary development unit according to the rotary development unit, even if a developer exchanger is rotated in order to exchange a developer to be placed in a development position, fresh toner can be prevented from being unintentionally supplied to the developer through a toner supply channel during the course of rotation of the developer exchanger, thereby preventing an excess quantity of toner from being stored in the developer. As a result, an electrostatic latent image formed over an image carrier can be developed at stable density.

If the number of rotations of the developer exchanger is counted by means of number-of-rotation count means, and the time period during which toner conveyor means is rotatively driven is corrected by means of quantity-of-supply correction means on the basis of the thus-obtained count value, there can be prevented a shortage of the quantity of fresh toner to be supplied to the developer which would otherwise be caused by rotation of the developer exchanger. As a result, the quantity of toner stored in the developer can be accurately controlled, thereby enabling development of an electrostatic latent image formed on an image carrier at stable density.

What is claimed is:

1. A rotary development unit comprising:

a plurality of developers for developing an electrostatic latent image formed on a latent image carrier with toner;

a developer exchanger which rotates while retaining the developers in a circumferential position around the developer exchanger and places at least one of the developers in a development position opposite to the latent image carrier;

a plurality of toner supply containers which store fresh toner to be supplied to the respective developers and are attached to the developer exchanger adjoining the respective developers;

toner supply channels which are provided substantially parallel with a rotary shaft of the developer exchanger and communicate respectively between the developers and the toner supply containers; and toner conveyor means for conveying a quantity of fresh toner corresponding to a given number of rotations of the toner conveyor means, from the toner supply containers to the respective developers through the respective toner supply channels, wherein the fresh toner in the toner supply channels is conveyed back to the toner supply containers from the developers when the toner conveyor means is suspended and the developer exchanger is rotated.

2. A rotary development unit according to claim 1, further comprising:

number-of-rotation count means for counting the number of rotations achieved by the developer exchanger until the developers left from the development position is reset to the development position again; and quantity-of-supply correction means which determines, from the number of counts measured by the number-of-rotation count means, a corrected value for a time period over which the toner conveyor means is rotatively driven; and which increases the time period only by the corrected value.

3. A rotary development unit as defined in claim 2, wherein the number-of-rotation count means counts the number of rotations achieved by the developer exchanger only when the toner conveyor means is suspended.

4. A rotary development unit as defined in claim 2, wherein an upper limit corresponding to a length of the toner supply channels is set with regard to the corrected value of the time period over which the toner conveyor means is rotatively driven.

* * * * *